US008246041B2

(12) United States Patent
Gagnon et al.

(10) Patent No.: US 8,246,041 B2
(45) Date of Patent: Aug. 21, 2012

(54) SYSTEM AND METHOD FOR MONITORING IMAGE FORMING MACHINE MEDIA STACK HEIGHT AND METHOD OF CALIBRATING STACK HEIGHT SENSING IN THE MONITORING SYSTEM

(75) Inventors: Daniel Robert Gagnon, Harrodsburg, KY (US); Robert Warren Rumford, Lexington, KY (US); John Thomas Writt, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 65 days.

(21) Appl. No.: 12/488,345

(22) Filed: Jun. 19, 2009

(65) Prior Publication Data

US 2010/0320676 A1 Dec. 23, 2010

(51) Int. Cl.
*B65H 43/00* (2006.01)

(52) U.S. Cl. ..... 271/117; 271/110; 271/153

(58) Field of Classification Search ..... 271/145, 271/152, 153, 154, 155, 117, 110
See application file for complete search history.

(56) References Cited

U.S. PATENT DOCUMENTS 5,653,434 A * 8/1997 Petocchi et al. ..... 271/122
5,927,703 A * 7/1999 Endo ..... 271/10.03
6,508,465 B1 * 1/2003 Endo ..... 271/265.01
6,659,449 B2 * 12/2003 Kim ..... 271/117
7,374,163 B2 * 5/2008 Cook et al. ..... 271/145
7,523,930 B2 * 4/2009 Kang ..... 271/152
2007/0052155 A1 * 3/2007 Cook et al. ..... 271/152
2007/0248365 A1 * 10/2007 Gettelfinger et al. ..... 399/16
2007/0248366 A1 * 10/2007 Gettelfinger et al. ..... 399/16
2009/0051099 A1 * 2/2009 Learmonth et al. ..... 271/3.09
2009/0110410 A1 * 4/2009 Gettelfinger et al. ..... 399/16
2009/0218758 A1 * 9/2009 Sano et al. ..... 271/225

* cited by examiner

*Primary Examiner* — Kaitlin Joerger
(74) *Attorney, Agent, or Firm* — John Victor Pezdek

(57) ABSTRACT

A system and method for monitoring media stack height utilizes a pick mechanism and stack height sensing mechanism. The pick mechanism has a pick arm and a pick roller, the arm rotatably mounted at one end to pivot about an axis and change its angular position relative thereto. The roller rotatably mounted to an opposite end of the arm contacts a media stack top and is rotatably driven to feed sheets one at a time from the stack top changing the stack height. The angular position of the arm relative to the stack changes as the stack height changes. The stack height sensing mechanism arranged on and adjacent to the arm senses arm angular displacement as the stack height changes to provide an indication of the sheet quantity remaining in the stack. A method for calibrating stack height sensing of the monitoring system provides one or more calibration points such as at "full stack" and "stack out" conditions.

15 Claims, 4 Drawing Sheets

SYSTEM AND METHOD FOR MONITORING IMAGE FORMING MACHINE MEDIA STACK HEIGHT AND METHOD OF CALIBRATING STACK HEIGHT SENSING IN THE MONITORING SYSTEM

CROSS REFERENCES TO RELATED APPLICATIONS

This patent application is related to the subject matter of co-pending U.S. patent application Ser. No. 12/266,232 filed Nov. 6, 2008 and Ser. No. 12/326,230 filed Dec. 2, 2008, assigned to the assignee of the present invention. The entire disclosures of these patent applications are hereby incorporated herein by reference.

BACKGROUND

1. Field of the Invention

The present invention relates generally to an image forming machine and, more particularly, to a system and method for monitoring media stack height in an image forming machine and a method of calibrating stack height sensing in the media stack height monitoring system.

2. Description of the Related Art

As a whole, image forming devices, such as inkjet printers, that feed sheets of media from a stack are deficient in their means to provide a warning of an impending depleted stack condition. As a consequence, if a user sends a job to such a device without knowing if there are a sufficient number of sheets in the stack for its completion, and if the stack depletes during the print job, the user will have to reload the stack and restart, causing a delay in the job's completion. With the proliferation of network inkjet printers, the ability to make a visual assessment of stack level is reduced, and the delays caused by unexpected stack depletions are more frequent and longer in duration.

U.S. Pat. No. 7,374,163, assigned to the assignee of the present invention, discloses a media stack height sensing mechanism in an image forming device which employs a pivotally mounted arm that is in contact with the top of a media stack. A flag attached to the arm is characterized by varying transmissivity. The flag is moveable with the arm so that as the position of the arm changes in relation to the stack height, a different portion of the flag is positioned between a transmitter and receiver of an optical sensing mechanism disposed within the image forming device. The flag accordingly reduces the amount of optical energy received by the receiver. The receiver output signal indicates the height of the media stack. The flag also includes features that further limit light transmission to the receiver to provide discrete stack height indications such as low, empty, full, or intermediate states. However, the addition of yet another single-function component to all image forming devices, like the media stack height sensor of the cited patent, is an additional benefit not justified by its added cost across the board for all image forming devices.

Thus, there is still a need for an innovation that can give a user an indication of the present stack height so that the user may adjust the stack load or the job format to ensure uninterrupted completion.

SUMMARY OF THE INVENTION

Embodiments of the present invention meet this need by providing an innovation that does not use stack contact and movement of a separate arm with a flag. Instead, the innovation uses stack contact and movement of a pick arm, a standard component on an image forming machine, which changes its angular position as the stack height changes as part of its normal single function of feeding sheets from the top of the stack. Therefore, underlying this innovation is the recognition by the inventors herein that the pick arm heretofore has been underutilized and could also be employed to perform this additional sensing function concurrently with its normal sheet picking or feeding function. Now the pick arm serves dual functions: its normal sheet feeding function plus performing part of a stack height sensing function. Assuming in terms of cost that the sensors per se utilized in the above-cited patent and in this innovation are at least equivalent, the stack height monitoring system provided by embodiments of the present invention reduces the cost of the approach of the above-cited patent through eliminating the requirement for a separate arm by mounting the sensor directly on the pick arm. This brings this innovation into the realm of cost-effectiveness. In addition to the cost savings by doing away with the need for a separate arm, the innovation also eliminates the additional contact by the arm with the media stack which can increase drag on the top sheet of the stack and negatively impact the performance of the picking operation. The innovation also involves a method of calibrating stack height sensing that enhances the utility of this approach for the user.

Accordingly, in an aspect of the present invention, a system for monitoring media stack height in an image forming machine includes a pick mechanism and a media stack height sensing mechanism. The pick mechanism has a pick arm and at least one sheet feeding pick roller. The pick arm rotatably mounted at one end about an axis undergoes pivotal movement about the axis which changes the angular position of the pick arm relative thereto. The sheet feeding pick roller rotatably mounted to an opposite end of the pick arm contacts a top of the media stack and is rotatably driven to feed sheets one at a time from the top of the media stack which changes the height of the media stack. The angular position of the pick arm relative to the media stack changes as the height of the media stack changes. The media stack height sensing mechanism is operatively coupled to the pick mechanism arm to sense angular displacement of the pick arm as the height of the media stack changes to provide an indication of the quantity of sheets remaining in the media stack. Thus, the pick mechanism performs dual functions of feeding sheets from the media stack thereby decreasing the stack height and of enabling the sensing of the remaining media stack height for providing of an indication of the quantity of sheets remaining in the media stack.

In another aspect of the present invention, a method for monitoring a media stack height in an image forming machine includes sensing the angular position of a pick mechanism arm, generating electrical signals having levels correlated to the pick mechanism arm angular positions that correspond to different stack height levels, measuring and storing values corresponding to the electrical signal levels, estimating at least one of the amount and percent of media sheets remaining in the media stack corresponding to at least one of the measured and stored values, and indicating the at least one of the amount and percent of media sheets remaining in the media stack.

In still another aspect of the present invention, a method of calibrating stack height sensing in the media stack height monitoring system in an image forming machine includes sensing the angular position of a pick mechanism arm, generating electrical signals having levels correlated to the pick mechanism arm angular positions that correspond to different stack height levels, measuring and storing at least one value corresponding to the level of the electrical signal at least at one of two calibration points: "full load" and "stack out" conditions of the media stack, estimating either the amount or percent of media sheets remaining in the media stack corresponding to measured and stored value of the electrical signal level at the at least one calibration point, and indicating either of the amount or percent of media sheets remaining in the media stack. The estimating includes performing a linear interpolation to estimate either of the amount or percent of media sheets remaining in the media stack.

BRIEF DESCRIPTION OF THE DRAWINGS

Figure 1:
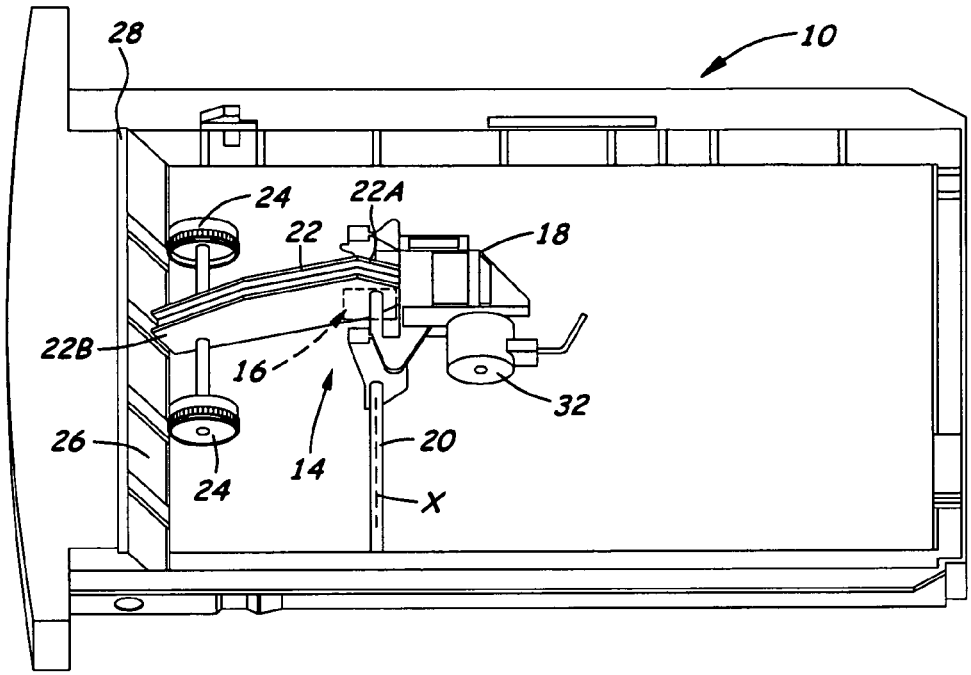

Having thus described embodiments of the present invention in general terms, reference will now be made to the accompanying drawings, which are not necessarily drawn to scale and in some instances portions may be exaggerated in order to emphasize features of the invention, and wherein:

FIG. 1 is a perspective view of an exemplary embodiment of a prior art pick mechanism shown in conjunction with a media tray of an image forming device and to which may be applied a sensing mechanism to provide a system and method for monitoring the media stack height in accordance with embodiments of the present invention.

Figure 2:
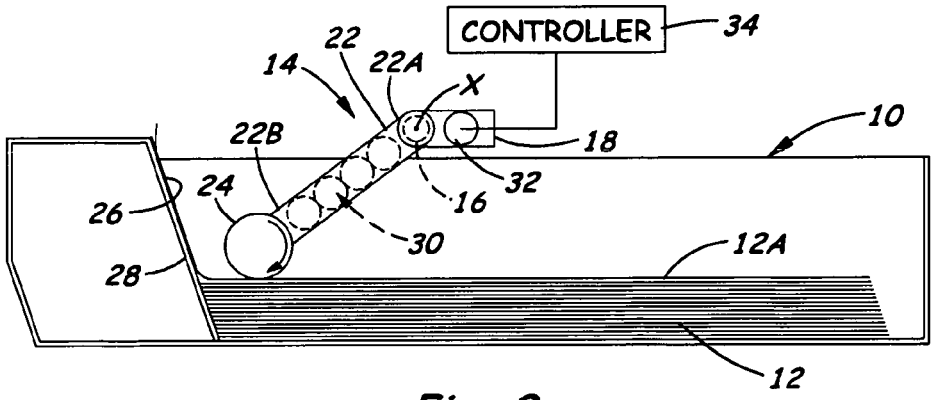

FIG. 2 is a schematic representation of the pick mechanism of FIG. 1 with the media stack height sensing mechanism applied thereto in accordance with embodiments of the present invention.

Figure 3:
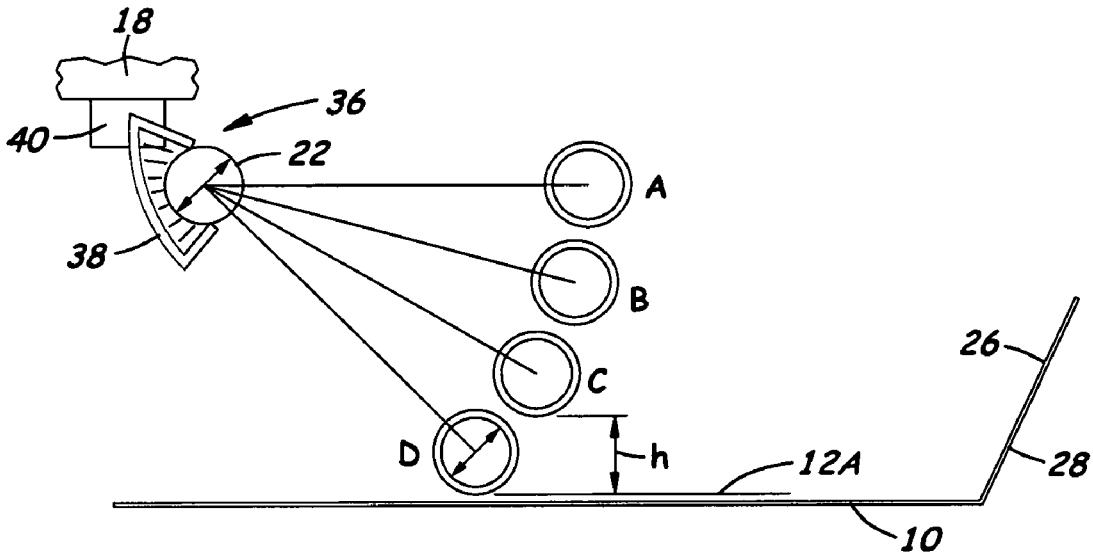

FIG. 3 is a schematic representation of one exemplary embodiment of the media stack height sensing mechanism employed in accordance with an embodiment of the present invention and various positions assumed by the sensing mechanism.

Figure 4:
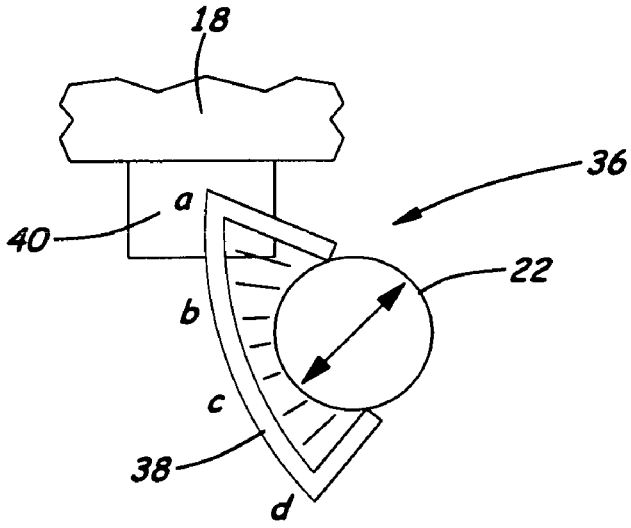

FIG. 4 is an enlarged schematic representation of the media stack height sensing mechanism of FIG. 3.

Figure 5:
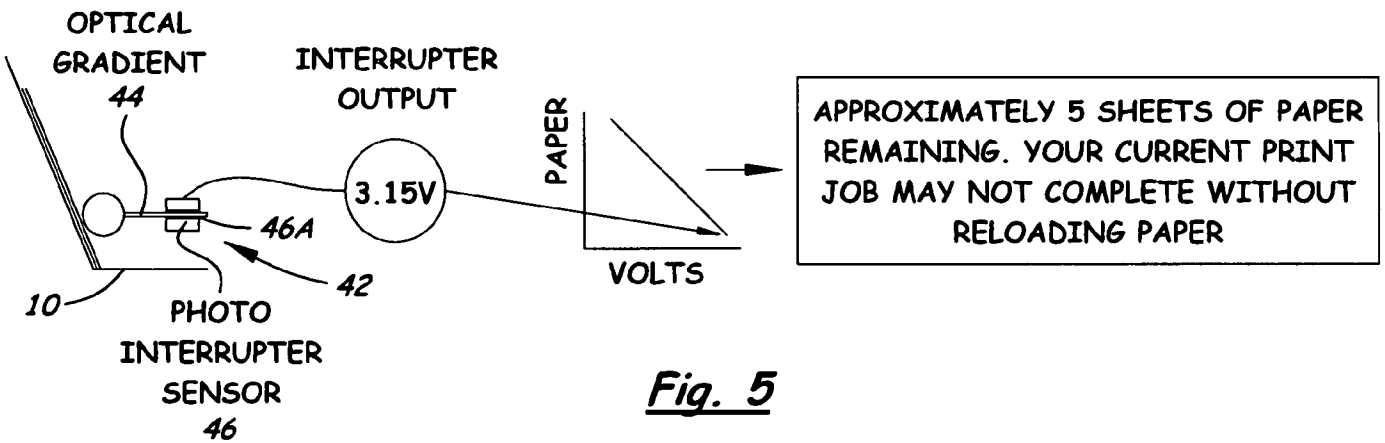

FIG. 5 is a diagrammatic representation of another exemplary embodiment of the media stack height sensing mechanism employed in accordance with the present invention and how the electrical signal generated by the sensing mechanism at one position corresponds to a low number of sheets remaining in the media stack.

Figure 6:
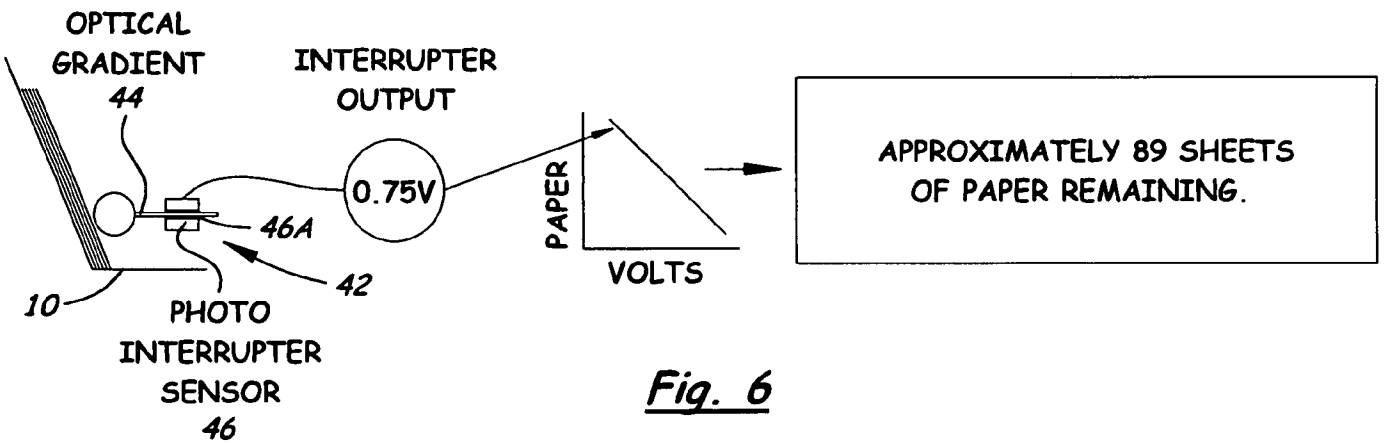

FIG. 6 is another diagrammatic representation of the media stack height sensing mechanism of FIG. 5 and how the electrical signal generated by the sensing mechanism at another position corresponds to a higher number of sheets remaining in the media stack.

Figure 7:
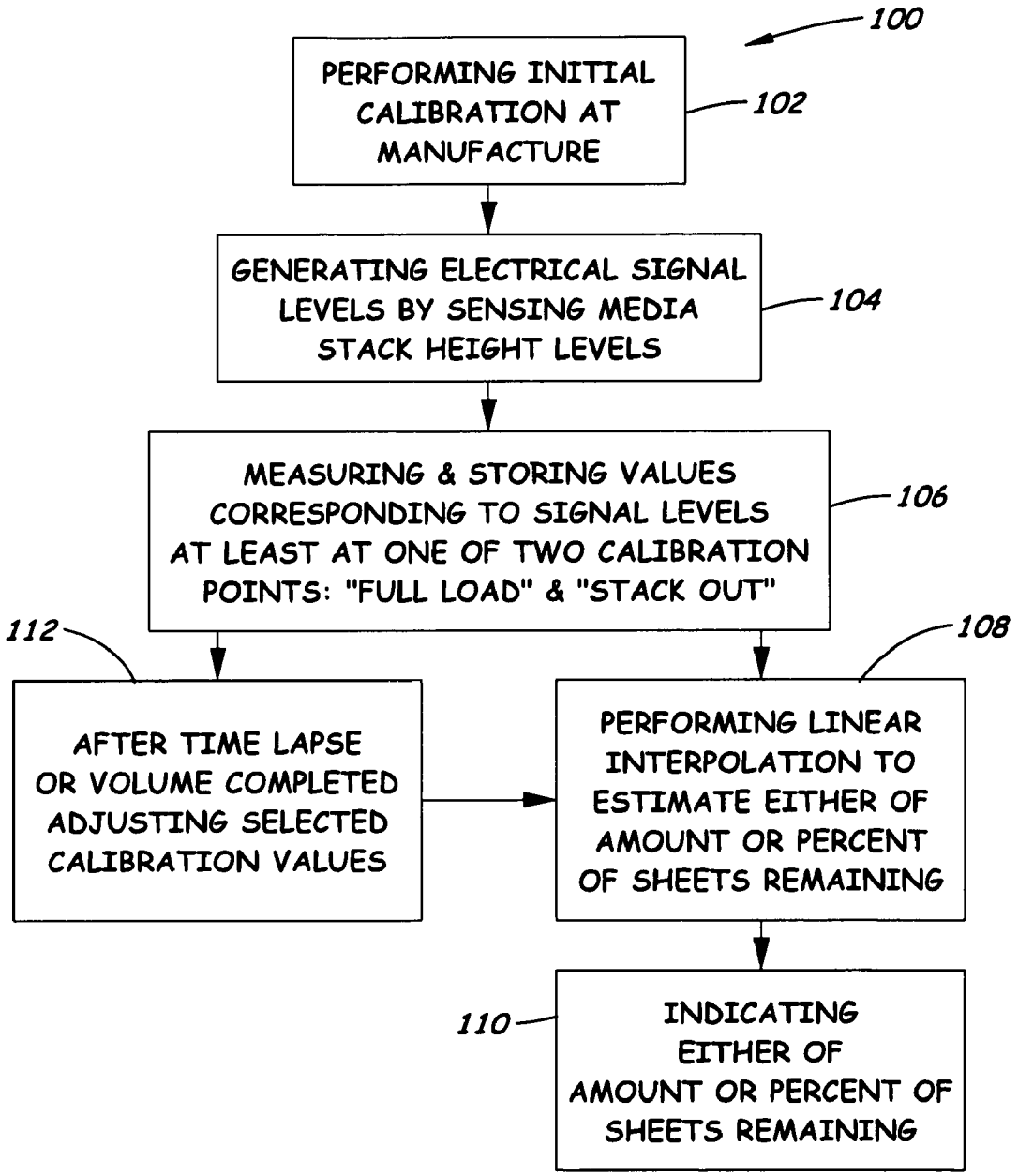

FIG. 7 is a flow diagram depicting a method for calibrating stack height sensing in the monitoring system in accordance with an embodiment of the present invention.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Referring now to FIGS. 1 and 2, there is illustrated a media input tray 10 supporting a media stack 12 and having a media sheet feeding pick mechanism 14 (also called an auto compensating pick mechanism). As shown in FIG. 2, a sensing mechanism 16, of a system and method for monitoring the height of the media stack 12 in accordance with embodiments of the present invention, may be applied to the pick mechanism 14 for sensing change in the media stack height. As seen in FIG. 1, the pick mechanism 14 includes a support bracket 18 that attaches to a framework (not shown) of an image forming machine (not shown), such as a printer. The pick mechanism 14 also includes a support shaft 20 that extends across the media tray 10 where it is mounted in a known stationary relationship to the support bracket 18. The pick mechanism 14 further includes a pick arm 22 that is pivotally mounted at one end 22A to the support shaft 20. The pick mechanism 14 also includes one or more sheet feeding pick rollers 24, also called pick tires, mounted to an opposite end 22B of the pick arm 22 and resting on the top 12A of the media stack 12. The pick rollers 24, which feed and advance media sheets one at a time from the top 12A of the media stack 12 up an inclined surface 26 of a dam 28 of the media input tray 10, are rotatably driven via a gear train 30 disposed within the pick arm 22, as shown in FIG. 2. The gear train 30 in turn is drivingly coupled to a motor 32 mounted to the support bracket 18 and controlled by a controller 34 of the printer. The pick arm 22 mounted to the support shaft 20 thus undergoes pivotal movement about an axis X defined by the support shaft 20 as the pick rollers 24 mounted on the end 22B of the pick arm 22 contact the top 12A of the media stack 12 and undergo rotation to feed sheets from the media stack 12 and thereby reduce the height of the media stack 12. The angular position of the pick arm 22 about the axis X and relative to the media stack 12 thus changes as the height of the media stack 12 changes.

As also shown in FIG. 2, the media stack height sensing mechanism 16 is connected in communication with the controller 34 and operatively coupled to the pick mechanism arm 22 and the support bracket 18, for example, adjacent to the axis X of the support shaft 20 about which the pick arm 22 rotates. The sensing mechanism 16 detects or senses the displacement or change in the angular position of the pick arm 22 as the height of the media stack 12 decreases. An electrical signal that correlates with the change in the angular position of the pick arm 22 and thus the decrease of the media stack height is generated and transmitted to the controller 34 where it is transformed to provide an output indicating the quantity of sheets remaining in the media stack 12. Thus, it will be readily understood that the pick mechanism 14 performs dual functions: first, the feeding of sheets from the media stack 12 thereby decreasing the stack height; and, second, enabling the sensing of the media stack height for providing an output indicating the quantity of sheets remaining in the media stack 12.

Turning now to FIGS. 3 and 4, there is shown an exemplary embodiment of the media stack height sensing mechanism 16 applied to the pick mechanism 14 in the system for monitoring the media stack height in accordance with the present invention. The range of motion for the pick mechanism arm 22 between locations "A" and "D", for instance, may be approximately 20 mm. The pick range is approximately 15 mm corresponding to 150 sheet (plain paper) input capacity. To provide the sensing mechanism 16 in the form of an encoder sensing mechanism 36, a first component in the form of an encoder wheel (or disk) 38 is mounted to the pick arm 22 to turn or rotate with the pick arm 22 and a second component in the form of an encoder sensor 40 is mounted to the support bracket 18 adjacent to the support shaft 20 and positioned adjacent and stationary relative to the encoder wheel 38. The encoder sensor 40 utilizes a selected electromagnetic energy such that the output of the encoder sensing mechanism 36 is an electrical signal, such as a sequence of pulses, which may be processed by the controller 34 and transformed into the change in the angular position of the pick arm 22 and correspondingly the change in the media stack height.

When the input tray 10 of the printer is removed or the pick mechanism motor 32 is reversed, the pick rollers 24 are in position "A" corresponding to the position "a" on the encoder wheel 38. This represents the home position of the encoder sensing mechanism 36. When the sheet is picked or fed by the pick mechanism 14, the pick mechanism motor 32 is turned in a forward drive mode, rotating the pick rollers 24 to the position "C" corresponding to position "c" on the encoder wheel 38, at some height "h" which represents an intermediate height of the media stack. The pick rollers position "B" represents a full media stack, such as of plain paper sheets. When the position of the pick mechanism arm 22 is near "D", a media stack low indicator would be activated on an operator panel (not shown) of the image forming device to alert an operator that the media needs to be refilled. The indicator could take various forms on the operator panel, such as illuminating an LED, generating a message on a LCD, or a notification window displayed on a computer screen via a driver. Depending on the resolution of the encoder sensing mechanism 36, the number of pages remaining could be compared to the print job to determine if the print job could be completed without refill.

Turning now to FIGS. 5 and 6, there is shown a diagram depicting another exemplary embodiment of the stack height sensing mechanism 16 which may be applied to the pick mechanism 14 in the system for monitoring the media stack height in accordance with the present invention. To provide the sensing mechanism 16 in the form of a photo optical gradient sensing mechanism 42, a first component in the form of an optical gradient 44 having an attachment end mounted to the pick arm 22 (FIG. 1) that may turn or rotate with the pick arm 22 and a second component in the form of a photo interrupter-type sensor 46 is mounted to the support bracket 18 (FIG. 1) adjacent to the support shaft 20 and positioned adjacent and stationary relative to the optical gradient 44 so that the optical gradient 44 is always in a view window of the photo interrupter sensor 46. The optical gradient 44 may take the form of a flat strip, such as seen in FIGS. 5 and 6, that will translationally slide through a slot 46A in the sensor 46 as the attachment end of the optical gradient 44 rotates, pivots or otherwise moves with the pick arm 22. As the media stack height changes, the angle of the pick arm 22 relative to the media stack changes, thus changing the position, and thus the portion, of the optical gradient 44 in the photo interrupter sensor 46. When the photo interrupter sensor 46 sees a different position on the optical gradient 44 it outputs a different voltage; it is this signal that is sent to the controller 34. Thus, the output of the photo optical gradient sensing mechanism 42 is an electrical signal in the form of a voltage signal received by the controller 34 and transformed into the change in the angular position of the pick arm 22 and correspondingly the change in the media stack height.

By defining and storing a predetermined relationship between stack height level, voltage level, and number of sheets in its firmware, the controller 34 is adapted to compute the actual number of remaining pages. For example, FIGS. 5 and 6 depict two different scenarios. In FIG. 5, the first scenario illustrated is of a relatively low media stack height/sheet count condition generating a sensor signal output level of 3.15 volts with a resulting output providing an indication to the operator that there are approximately five media sheets remaining. In FIG. 6, the second scenario illustrated is of a relatively normal or sufficient media stack height/sheet count condition generating a sensor signal output level of 0.75 volts with a resulting output providing an indication to the operator that there are approximately 89 media sheets remaining.

The photo interrupter sensor 46 used in the sensing mechanism 42 has near infinite resolution in that every increment of change in stack height produces a change in voltage and thus there is the potential to track stack height with much more precision. Furthermore, in accordance with a flow diagram 100 shown in FIG. 7 the photo interrupter sensor 46 is also capable of being calibrated so that tolerances and part variations can be discounted and the resulting stack height measurement made far more accurate. Specifically, due to variances in LED output and light detector sensitivity in photo interrupter sensors, as well as positional tolerances, the sensing mechanism 42 is advantageously calibrated on a per printer basis to correlate voltage level with stack level. As per block 102, most advantageously an initial calibration may be done at the time of manufacture. To initiate the calibration, an electrical signal is generated by sensing the angular position of the pick mechanism arm 22 corresponding to a different stack height such that the level of the signal is correlated with stack level, as per block 104. The level of the signal is measured and recorded or stored at least at one and preferably two points: "stack out" and "full load", as per block 106. The controller 34 can then perform linear interpolation, as per block 108, to estimate the amount of media stack left in the input tray 10 of the printer. This amount can be communicated as an output indicating to the operator either a certain number of sheets or as percent full, as per block 110.

Over time, the correlation between stack level and signal level can change due to changes in the LED output over useful life and due to accumulation of dust. If the general characteristics of this change are known, an "open loop" adjustment or repeating of the calibration can be made throughout the life of the printer, as per block 112, automatically adjusting the correlation in response to time elapsed and/or volume of printing completed. The process then proceeds to block 108. Printers with the ability to detect stack out independent of the stack level sensor would have the ability to update the "stack out" calibration point on the two-point calibration automatically at any stack out occurrences. The "full load" calibration point could then be adjusted in a similar manner based upon the amount of shift observed in the "stack out" calibration point.

For completeness, it should be mentioned that, if needed, any calibration shifting due to environmental variation could be compensated for in an open loop manner by measuring the temperature (via a dedicated sense resistor and/or monitoring thermal effects of the printhead) and applying the appropriate shift in the calibration points based upon the known characteristics of the photo interrupter sensor. In addition, if needed, during initial setup the printer could take a stack out measurement and adjust the factory calibration as needed, similar to the above.

Further correlation between signal level and stack level can be accomplished during normal printing, as per block 108. For example, if the operator prints a job of sufficient length (say, at least 15 pages), the signal level before and after the job can be measured. Since the number of pages that have been picked from the input tray is known, the correlation (slope) between signal level and pages can be used to adjust the calibration points and/or the correlation between tray percent full and number of sheets.

Signal levels outside of the anticipated range may be useful in alerting the operator of potential problems. For example, if the signal measured is beyond the level correlated with the full load mark, as per block 110, an indication may be provided so that the user could learn of a potential overfilling or that the page may have advanced past the buckler/dam and may need to be reloaded before a jam/double feed occurs.

The stack height sensing mechanism 16 in FIG. 2 may be implemented in other alternative embodiments in association with the pick mechanism 14. One alternative embodiment is the use of a potentiometer where the position of the pick arm 22 is transmuted to a change in resistance to be read by an ADC (analog-to-digital converter) channel. Another alternative embodiment is the use of a sonar transmitter and sonar sensor to detect the position of the pick arm 22. Still another embodiment is the use of a paper flag where the flag position at "d" trips the sensor and provides a media stack low indication given to the user. Yet another alternative embodiment is the use of a reflective gradient and sensor where the reflective gradient has varying amount of reflectivity along its length. All of these components generate some form of an electrical signal which changes in proportion to the change in the height of the media stack as represented by the change in the angular position of the pick mechanism arm 22 sensed by the sensing mechanism 16.

One advantage of embodiments of the present invention as provided by the stack height sensing mechanism 16 implemented with the pick mechanism 14 is the provision of an indirect measure of media stack height without impacting the sheet picking or feeding operation. Some indirect measurement methods use a linkage which contacts the media stack to establish height. Such contact with the media stack can impact pick performance reliability due to increased drag. Another advantage is the provision of a relatively low cost implementation solution (versus other complex sensor solutions). Additionally, this solution provides more precise information to the operator about the status of the media stack height compared to where no paper stack height notification is available other than by the operator merely looking into the input tray 10.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A system for monitoring media stack height in an image forming machine, comprising:

a pick mechanism having a pick arm and at least one sheet feeding pick roller, said pick arm rotatably mounted at one end for undergoing pivotal movement about an axis so that the angular position of said pick arm can change relative to said axis, said pick roller mounted to an opposite end of said pick arm, contacting a top of a media stack and driven to feed sheets one at a time from the top of the media stack which changes the height of the media stack such that the angular position of said pick arm relative to the media stack changes as the height of the media stack changes;

a media stack height sensing mechanism operatively coupled to said pick mechanism arm to sense angular displacement of said pick arm as the height of the media stack changes to provide an output indicating the quantity of sheets remaining in the media stack, said pick mechanism thereby performing dual functions of feeding sheets from the media stack thereby decreasing the media stack height and of enabling the sensing of the remaining media stack height for providing of an indication of the quantity of sheets remaining in the media stack; and a controller coupled to said media height sensing mechanism that estimates a quantity of sheets remaining in the media stack based on the angular displacement of said pick arm sensed and provides an output indicating the quantity of sheets remaining.

2. The system of claim 1 wherein said sensing mechanism includes an encoder wheel mounted on said pick arm for undergoing rotational movement with said pick arm, said encoder wheel having a pattern of markings thereon.

3. The system of claim 2 wherein said sensing mechanism also includes an encoder sensor mounted adjacent to said pick arm and stationary relative to said encoder wheel, said encoder sensor utilizing selected electromagnetic energy to interact with said markings on said encoder wheel and sense the angular displacement of said encoder wheel with said pick arm and thereby the angular displacement of said pick arm as the height of the media stack changes for producing a pulsed output corresponding to the angular displacement of said encoder wheel with said pick arm and thereby the change in the height of the media stack.

4. The system of claim 1 wherein said sensing mechanism includes an optical gradient mounted on said pick arm for undergoing movement with said pick arm.

5. The system of claim 4 wherein said sensing mechanism includes a photo interrupter sensor mounted adjacent to said pick arm and stationary relative to said optical gradient with said optical gradient disposed in a view window of said photo interrupter sensor for undergoing translational movement relative thereto so that said photo interrupter sensor sees different positions on said optical gradient as the angular position of said pick arm changes and thus the media stack height changes, said photo interrupter sensor utilizing a selected electromagnetic energy to interact with said optical gradient for generating an electrical signal which changes in magnitude in proportion to the height of the media stack.

6. The system of claim 1 wherein said sensing mechanism includes a potentiometer and sensor.

7. The system of claim 1 wherein said sensing mechanism includes a sonar transmitter and a sonar sensor.

8. The system of claim 1 wherein said sensing mechanism includes a flag and an optical sensor.

9. The system of claim 1 wherein said sensing mechanism includes a reflective gradient and an optical sensor.

10. A system for monitoring media stack height in an image forming machine, comprising:

a support frame mounting a shaft defining an axis;

a pick mechanism having a pick arm and at least one sheet feeding pick roller, said pick arm rotatably mounted at one end by said shaft for undergoing pivotal movement about said axis so that the angular position of said pick arm can change relative to said axis, said pick roller mounted to an opposite end of said pick arm, contacting a top of a media stack and driven to feed sheets one at a time from the top of the media stack which changes the height of the media stack such that the angular position of said pick arm relative to the media stack changes as the height of the media stack changes;

an encoder wheel mounted on said pick arm for undergoing rotational movement with said pick arm, said encoder wheel having a pattern of markings thereon;

an encoder sensor mounted on said support frame adjacent to said pick arm and stationary relative to said encoder wheel for sensing the angular displacement of said encoder wheel with said pick arm and thereby the angular displacement of said pick arm as the height of the media stack changes and producing a pulsed output corresponding to the quantity of sheets remaining in the media stack; and a controller coupled to said encoder sensor that estimates a quantity of sheets remaining in the media stack based on the angular displacement of said pick arm sensed and provides an indication of the quantity of sheets remaining in the media stack.

11. A method for monitoring a media stack height in an image forming machine, comprising:

sensing an angular position of a pick mechanism arm by a sensing mechanism mounted on said pick mechanism arm that undergoes rotational movement with said pick mechanism arm;

estimating at least one of the amount and percent of media sheets remaining in the media stack based on the angular position of said pick mechanism arm sensed; and indicating said at least one of the amount and percent of media sheets remaining in the media stack.

12. The method of claim 11 wherein said estimating includes performing a linear interpolation to estimate said at least one of the amount or percent of media sheets remaining in the media stack.

13. The method of claim 11, further comprising:

generating electrical signals having levels correlated to the pick mechanism arm angular positions that correspond to different stack height levels; and measuring and storing values corresponding to said electrical signal levels, wherein the measured and stored values are used to estimate said at least one of the amount and percent of media sheets remaining in the media stack.

14. The method of claim 13, wherein said generating includes sensing every increment of change in the media stack height level such that said electrical signals correlate to said every increment of change in the media stack height level.

15. The method of claim 13 wherein said sensing mechanism has a sufficient resolution in that every increment of change in stack height produces a change in electrical signal voltage.

* * * * *